US006948287B2

(12) United States Patent
Korn

(10) Patent No.: US 6,948,287 B2
(45) Date of Patent: Sep. 27, 2005

(54) GAP SEAL ON A BUILDING STRUCTURE

(76) Inventor: Doris Korn, Wieterfeld 12, D-37154 Northeim (DE)

( * ) Notice: Subject to any disclaimer, the term of this patent is extended or adjusted under 35 U.S.C. 154(b) by 0 days.

(21) Appl. No.: 09/878,900

(22) Filed: Jun. 11, 2001

(65) Prior Publication Data

US 2002/0014046 A1 Feb. 7, 2002

(30) Foreign Application Priority Data

Jun. 9, 2000 (DE) ..... 100 28 202
Jun. 9, 2000 (DE) ..... 200 15 845
Oct. 9, 2000 (DE) ..... 100 50 113

(51) Int. Cl.[7] ..... E04F 15/22

(52) U.S. Cl. ..... 52/393; 52/396.03; 52/282.5; 52/288.1; 52/273; 52/35; 52/716.1; 52/716.2; 4/538; 4/695; 277/628; 277/650; 277/510

(58) Field of Search ..... 52/393, 396.03, 52/282.5, 288.1, 273, 35, 716.1, 716.2, 287.1, 255, 718.05, 741.1, 717.03, 718.03, 718.01; 4/538, 695; 277/628, 650, 510

(56) References Cited

U.S. PATENT DOCUMENTS 2,090,588 A * 8/1937 Witsell ..... 52/35
2,541,768 A * 2/1951 Keller ..... 52/287.1
3,222,837 A * 12/1965 Daley ..... 52/287.1
3,646,716 A * 3/1972 Jenner ..... 52/396.04
4,315,390 A * 2/1982 Schaafsma ..... 52/287.1
4,601,149 A * 7/1986 Dokan ..... 52/287.1
4,654,250 A * 3/1987 Black et al. ..... 428/195
4,719,733 A * 1/1988 Seles ..... 52/287.1
4,829,730 A * 5/1989 Zeilinger ..... 52/287.1
4,982,457 A * 1/1991 Donaton ..... 4/504
5,283,997 A * 2/1994 Lackie ..... 52/287.1
5,562,107 A * 10/1996 Lavender et al. ..... 128/888
D383,058 S * 9/1997 Riley et al. ..... D8/499
5,730,446 A * 3/1998 Taylor et al. ..... 277/312
6,305,425 B1 * 10/2001 Korn ..... 138/110
6,401,418 B1 * 6/2002 Senn et al. ..... 52/506.01
6,427,405 B1 * 8/2002 Moriya et al. ..... 52/396.04
6,435,373 B1 * 8/2002 Mizrahi ..... 222/105

* cited by examiner

*Primary Examiner*—Carl D. Friedman
*Assistant Examiner*—Christy M. Green
(74) *Attorney, Agent, or Firm*—Laurence A. Greenberg; Werner H. Stemer; Ralph E. Locher

(57) ABSTRACT

The invention concerns a permanently functional gap seal on structures, in particular building structures, which ensures a reliable seal against penetrating moisture, this being achieved in that the cover layer has a profile which can be adapted to an installation situation over a joint or on an inner or outer corner and has a central part and side wings disposed on both sides of the central part, and in that at least the side wings have contact surfaces for contacting a sealant.

18 Claims, 3 Drawing Sheets

GAP SEAL ON A BUILDING STRUCTURE

BACKGROUND OF THE INVENTION

Field of the Invention

The invention relates to a gap seal on a structure, in particular a building structure, using a water-tight cover layer disposed over a joint of structure, a corner of a structure or on an offset part of a structure.

Building-structure seals against moisture from the ground and against water which does or does not exert hydrostatic pressure in accordance with DIN 18 195 are known, for example, as "unlined tanking" made of water-impermeable concrete or as "lined tanking" made of seals which retain pressurized or built-up water. Such building-structure seals are made of bitumen sheeting and plastic sheet material with or without a fabric insert or a thick asphalt coating with or without a fabric insert. Some of the sealing measures mentioned above in the above DIN document are regarded as not corresponding to the recognized rules of technology, with the result that, despite such building-structure seals being installed in accordance with DIN, structural damage may be produced by penetrating moisture. A relatively high risk of structural damage is brought about here by the known susceptibility to deficiencies and/or damage of drainage systems.

Furthermore, the roof-sealing methods in accordance with the flat-roof guidelines of the Zentralverband des deutschen Dachdeckerhandwerks [Central Association of the German Roofing Trade] disclose a very high-outlay layer construction which is intended for sealing building structures and all types of pipe or cable bushings. The above-noted flat-roof guidelines also provide a wide variety of possible ways for very high-outlay and/or incorrect installation and only a small number of possible methods for expert repair or renewal, in particular also of cable or pipe bushings.

SUMMARY OF THE INVENTION

It is accordingly an object of the invention to provide a gap seal on building structures which overcomes the hereinafore-mentioned disadvantages of the heretofore-known devices and methods for sealing a gap on building structures. The invention makes available a permanently functional building-structure seal, in particular in conjunction with a thick asphalt coating, which ensures a reliable seal even against water which exerts hydrostatic pressure, in particular with cohesive soil without drainage. The invention is straightforward, cost-effective and makes available a permanently functional building-structure seal.

This object is achieved according to the invention by way of a sealant, and a water tight cover layer including a profile, the profile having a central part with two sides and the profile having side wings disposed at the two sides, at least the side wings having a length and contact surfaces over the length are coated said sealant.

One feature of the instant invention is that the sealant forms a continuous, cured sealing layer between the contact surfaces and a building structure, once the profile has been subjected to pressure. The sealant can be a resin which cures to a tough state or a resin which cures to an elastic state Another feature of the instant invention is that the sealant is stored in at least one hollow body assigned to a gap seal and has a casing which can be destroyed during a installation of the profile.

One feature of the instant invention is that the profile is in a form selected from the group consisting of a web form in strips, wound up to form a roll, and a sectional piece. Also, the profile can be in a form corresponding to round parts of a building for sealing the round parts of the building, or the profile can be in a form corresponding to polygonal parts of a building for sealing the polygonal parts of the building. The sectional piece is can be constructed as a corner element for an inner or outer corner where the corner element can have partially overlapping side wings for angle adaptation to a corner.

One feature of the instant invention is that the profile is one of two adjacent profiles, and an abutment region is disposed between the two adjacent profiles. The two adjacent profiles are having end sides constructed as to correspond to one another such that, in the joined-together state, a gap for the sealant is produced, the gap being open in the outward direction from a building side.

One feature of the instant invention is that spikes are disposed on a side of the central part which is directed toward a building corner, for the purpose of specifically destroying the hollow body.

Another feature of the instant invention is that there are film hinges disposed between the central part and the side wings.

Another feature of the instant invention is that the central part has at least one surface selected from the group consisting of a planar surface, a concavely curved surface and a convexly curved surface.

Another feature of the instant invention is that the central part is at least partially elastic.

Another feature of the instant invention is that the contact surfaces of the side wings are directed toward a building surfaces and are profiled.

Another feature of the instant invention is that, for a right-angled inner corner, the central part is flat and planar and is to be placed approximately at an angle of 45° in front of a building corner. The two side wings are angled outward at an angle of approximately 135° from the central part.

Another feature of the instant invention is that, for an outer corner, the profile is angled with an inner angle which is slightly smaller than the angle of the outer corner.

Another feature of the instant invention is that, for an outer corner, said profile is angled with an inner angle which is equal to, the angle of the outer corner.

Another feature of the instant invention is that the central part is constructed as a film hinge.

Another feature of the instant invention is that the hollow body has a cross-sectional surface area which is larger than a cross-sectional surface area of a free space between a corner of a building and the central part.

Another feature of the instant invention is that the profile is constructed as a circular-cylindrical body for the purpose of sealing a round pipe, or constructed as a polygonal frame for the purpose of sealing a polygonal pipe.

Another feature of the instant invention is that the side wings are formed into a pipe portion which has pipe shoulders which decrease in a direction of a free end in a manner selected from a group of a stepwise and continuous manner.

Another feature of the instant invention is that the side wing are formed into a pipe portion which has pipe shoulders which decrease in a direction of a free end in a manner selected from a group of a stepwise and continuous manner.

Another feature of the instant invention is to include an encircling inner corner formed by the round pipe and a plate-like outer section of a pipe bushing, the pipe bushing has a hollow-cylindrical section which extends into a wall recess, and positioned in the hollow-cylindrical section is a sealing ring by means of which the sealant is being prevented from flowing out.

Another feature of the instant invention is that the profile has one of the side wings disposed on a wall and the other one of the side wings disposed on a projecting length of slabs which project beneath a masonrywork of the wall and are secured on the floor slab by a sealing layer made of resin. The slabs may have a profiled underside.

Another feature of the instant invention is that a planar surface of the profile is constructed in a rough state as the contact surface.

Another feature of the instant invention is that the central part of the profile extends freely into a joint for use in a joint seal for a settlement joint.

Another feature of the instant invention is that the hollow body filled with the sealant is disposed beneath each of the side wings prior to the installation of the profile.

Another feature of the instant invention is that the spikes are disposed beneath the side wing.

Another feature of the instant invention is that there are lips disposed on the central part and the side wings for preventing a backflow of the sealant.

Another feature of the instant invention is that the contact surfaces have a profile selected from the group consisting of honeycomb profile, longitudinal grooves and transverse grooves disposed rectilinearly, longitudinal grooves and transverse grooves disposed in an offset manner in relation to one another.

Another feature of the instant invention is that the profiles of the contact surfaces have different heights.

Another feature of the instant invention is that the profile have profiled contact surfaces on the side wings.

Another feature of the instant invention is that the side wings have different wing widths.

Another feature of the instant invention is that the cover layer being disposed over a joint of a building, in or in front of a corner of a building or on an offset part of a building.

This solution makes available a permanently functional building-structure seal, in particular in conjunction with a thick asphalt coating, which ensures a reliable seal even against water which exerts hydrostatic pressure, in particular with cohesive soil without drainage. Provided at the same time is a particularly straightforward-to-install, and thus absolutely water-tight, solution for corner seals of upright structural parts and concave moldings on foundations, attics, balconies, showers, window sills, terrace terminations and also for roof surfaces, cap flashing pieces, strip fittings for bridges, parking decks and, in addition, also for settlement joints and even cable and pipe bushings.

Since the cover layer includes a profile which is, or can be, adapted to an installation situation over a joint or on an inner or outer corner and has a central part and side wings disposed on both sides of the central part, and at least the side wings have, over their length, contact surfaces for coating with a sealant, it is possible, by virtue of the selection of the sealant, for example resin or adhesive, and the method of applying the same, be this by brush application, spraying or filling, to achieve an optimized gap seal to solve virtually any conceivable problem. Also, any gaps which may be present beneath the profile also being filled by the sealant.

Furthermore, the stiff formation of the profile, in particular in the case of pipe bushings, produces, in addition to the absolute sealing characteristics, a very high level of stability. Hence, on account of the construction, an optimized stressing in the pipes is achieved, without sudden drastic changes, which could result in the pipes being destroyed or skewed.

Further advantageous configurations of the subject matter of the invention can be gathered from the following subclaims, also in combination therewith.

According to a particularly preferred embodiment of the invention, the sealant forms a continuous, cured sealing layer, once the profile has been subjected to pressure, between the common contact surfaces of the gap seal and a building structure, said sealing layer having a minimum layer thickness which prevents moisture from penetrating between the profile and a wall, ceiling, or a floor.

A configuration of the invention which is to be emphasized as being particularly advantageous, in particular, for DO-IT-YOURSELF enthusiasts is one in which, in the as yet uninstalled, new state of the profile, at least one hollow body which is filled with a sealant and has a destructible casing is disposed on a profile side which is directed toward the building. It being possible for said casing to be destroyed during the installation, with the result that the sealant always has the desired quality and consistency and can easily be distributed between the contact surfaces of the gap seal and a building corner. The hollow body is preferably produced from a thin plastic skin which can easily be destroyed by virtue of the profile being pressed onto or into a corner. Subsequently, it is ensured that the gap seal is processed in an extremely straightforward manner, which is reliable in terms of installation, without the quality of the sealing being dependent on the day-to-day performance of a worker.

The particular advantage with this inventive gap seal is that, rather than a gap or corner simply being covered over, the sealant also flows into any joints present and, by virtue of its inherent adhesion, coats the surfaces of a gap or corner to the full extent and thus, in the cured state, produces a permanent seal. Such a seal is reliable to the extent where it is possible to dispense completely with drainage, for example in the foundation region of a building structure, with the result that the structural outlay and the resulting costs are also reduced to a considerable extent.

The sealant preferably consists of a resin which has one or more components and cures to form a tough or elastic sealing layer, with the result that expansion or settlement joints, at corners or offset parts of a building (or buildings), which are provided with the gap seal remain sealed in a water-tight manner. The remaining capacity for expansion of the cured sealing layer can be set, by prior influencing of the sealant, for example to 100%, with the result that, with the resin, an expansion which cannot be realized with other known gap seals is permissible. A permissible capacity for expansion of up to 300% is possible here. It is also emphasized as being essential, in the case of sealing of plastic pipes by means of said gap seal, that the surface of such a plastic pipe begins to dissolve slightly, which results, overall, in a partially integral and thus extremely durable and absolutely water-tight connection.

Depending on the use purpose, the profile may optionally be in web-like strips or be wound up to form a roll or in the from of a section. Such a section of a profile, for sealing round or polygonal parts of a building or buildings, may advantageously be formed as a segment in a manner corresponding to said parts of the building, for example it is possible for a plurality of curved segments to be joined together to form a ring and thus to seal the foot of a circular-cylindrical part of the building. Such a segment may also be a corner element for an inner or outer corner and in addition, for angle adaptation to a corner which is to be sealed, may have partially overlapping side wings, with the result that corners which deviate from an ideal dimension can also be sealed reliably.

Also of particular advantage is an embodiment which, in the abutment region between two adjacent profiles or segments, has end sides which corresponds to one another such that, in the joined-together state, a gap for the sealant is produced, said gap being open in the outward direction from the building side, and the sealant penetrating into said gap and connecting two profiles or segments to one another in a water-tight manner.

Over the entire length, that side of the central part which is directed toward a corner, and/or the side wings of the profile, may have spikes which serve for specifically destroying the hollow bodies, which results in uniform distribution of the sealant.

The central part of a profile need not necessarily comprise a rectilinear, planar surface; rather, depending on the application, it may comprise one or more planar or concavely or convexly curved surfaces which, as is also the case between the side parts and the central part, may be connected to one another via film hinges. Also advantageous is an embodiment of the invention in which the central part is wholly or partially elastic, in particular if, rather than gaps, expansion joints of buildings such as parking decks or flat roofs or terraces are to be covered over using the gap seal. In the case of such a gap seal is a joint seal for a settlement joint, the central part extends preferably freely into a joint. For the installation of this embodiment, a hollow body filled with sealant is preferably disposed beneath each side wing, and may be retained there by retaining struts. In such an embodiment, the spikes for destroying the hollow body are likewise located beneath the side wings. Of course, the installation of such a gap seal may likewise take place by a separate application of the adhesive or resin to the corresponding building surfaces and/or the side wings of the profile.

Also to be regarded as particularly advantageous is an embodiment of the profile in which the insides of the side wings, which are directed toward a corner, are provided with a profiling such as longitudinal or transverse grooves, corrugations, honeycomb formations or the like which are disposed rectilinearly or in an offset manner in relation to one another and may also have different heights. This, on the one hand, serves to increase the surface area and thus the adhesive strength of the sealant and, on the other hand, ensures a minimum layer thickness of the sealing layer. In an embodiment of a profile with grooves running vertically in the installed position it is possible for additional thin elastic lips to be inserted into said grooves as backflow-prevention means, in order to prevent the resin from flowing back out of the region of the side wings during the installation.

A profile for a right-angled inner corner preferably has a central part, which is placed at an angle of 45° in relation to the corner, and two side wings which are angled outward at an angle of 135° from said central part. However, it is also possible for the central part to be disposed in the direction of the corner at any other angle, in which case the connection angles of the side wings then change correspondingly. A hollow body is secured on the central part and preferably has a free inner cross-sectional surface area for the resin which is at least equal to, but preferably larger than, the cross-sectional surface area of the envisaged free space between the corner and the central part, with the result that it is ensured that a sufficiently large quantity of sealant is available and the latter can also be squeezed into any gaps present, and beneath the profiled side wings, by virtue of the profile being pressed into a corner. Also conceivable here are two or more hollow bodies disposed beneath the central part, or also beneath the side wings, or also a different method of applying the sealant by means of a brush or by spraying or filling.

For an outer corner, the profile, as angled profile, may have an inner angle which is slightly smaller than, or equal to, the angle of the outer corner, in order for it to be able to be disposed on a building corner in a reliable and gap-free manner.

According to a further advantageous embodiment of the invention, the profile of the gap seal of an inner corner may also serve for sealing a pipe guided through a wall or ceiling and, for this purpose, be in closed form; for example, in the case of a polygonal pipe, it may be constructed as a polygonal frame or, in the case of a round pipe, may be constructed as a round structure with a plate-like, a conical and a tubular section. Furthermore, such a round gap seal may particularly advantageously be combined with an already installed pipe bushing to form a sealing system if the pipe bushing likewise provides a plate-like outer section of which the surface, in conjunction with the adjacent surface of the pipe, forms an inner corner which is to be sealed. Such a pipe bushing having a hollow-cylindrical section alongside the plate-like section, where the hollow-cylindrical section extending into a wall recess and having an internal diameter which is slightly larger than the external diameter of a pipe, may preferably be provided, in its hollow-cylindrical section, with a sealing ring which prevents the sealant of the gap seal from flowing out into the interior of a pipe bushing.

In particular for renewal purposes, a side wing which is formed into a pipe portion may have pipe shoulders which decrease in a stepwise or continuous manner, in order to be able to be fitted over old structures of pipe or cable bushings which are to be renewed, a sealed connection to old, often multi-layered, sheet-material structures located therebeneath being achieved reliably and extremely straightforwardly by the resin.

According to a further advantageous embodiment of the invention, at least the free surface of the profile is constructed in a rough state as contact surface, in order to ensure incorporation of further sheet materials, roof sheeting or insulation.

It is advantageous for an individual profile for an inner or optionally an outer corner to be constructed with side wings which are provided with correspondingly profiled contact surfaces on both sides, with the result that such a profile can be used even more universally.

Of course, it is also possible to produce a profile with side wings of different widths, and it is also possible for the width of the side wings to be varied as desired in relation to that of the central part.

A further advantageous embodiment of the gap seal consists in combining a profile for an inner corner with a projecting length of slabs which project beneath the masonrywork of a wall, one side wing of a profile being disposed on the wall and the other side wing being connected to the projecting length, the slabs themselves being secured on the floor slab by means of a sealing layer made of resin and likewise having a profiled underside.

Other features which are considered as characteristic for the invention are set forth in the appended claims.

Although the invention is illustrated and described herein as embodied in a gap seal on building structures, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
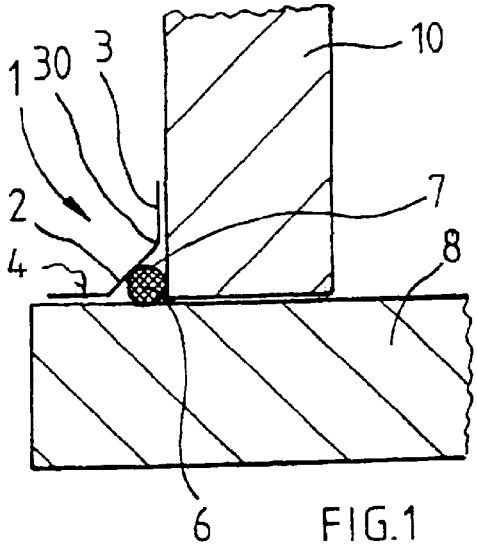
FIG. 1 is a fragmentary, diagrammatic, sectional view of an inner corner on a foundation base with the gap seal positioned against it.
Figure 2:
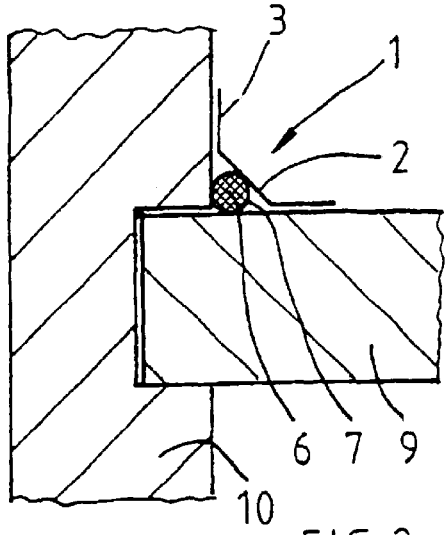
FIG. 2 is a fragmentary, diagrammatic, sectional view of an inner corner on upright structural parts.
Figure 3:
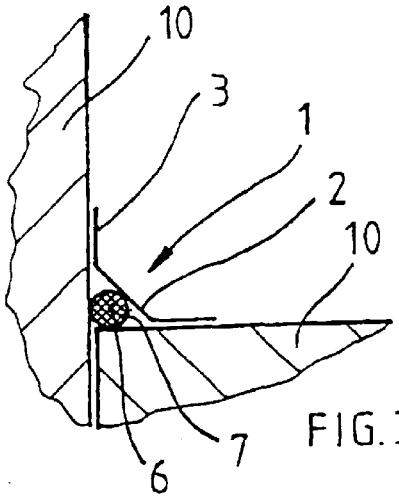
FIG. 3 is a fragmentary, diagrammatic, sectional view of a horizontal or vertical inner corner.
Figure 4:
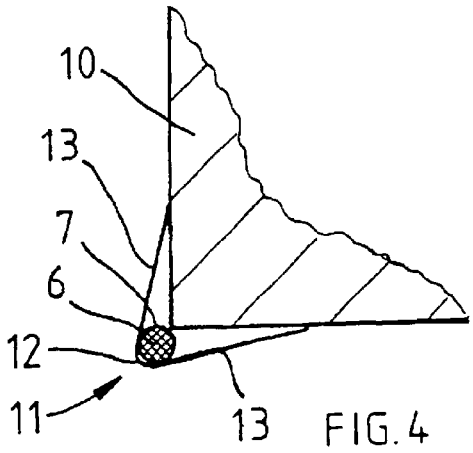
FIG. 4 is a fragmentary, diagrammatic, sectional view of an outer corner with the gap seal merely positioned against it.
Figure 5:
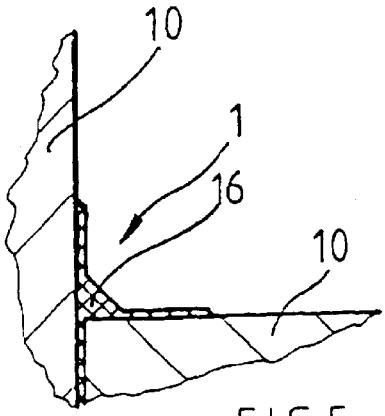
FIG. 5 is a fragmentary, diagrammatic, sectional view of a finished gap seal according to FIG. 3.

Referring now to the figures of the drawings as a whole, there is seen a gap seal for building structures that includes a profile 1;1'11;21;31;41;51, which has a central part 2;2';12;22;32;42;52 and two side wings 3;3';13;23;33;43;53 each butting against a different side of a corner or of a joint 48;58, and also includes a hollow body 7 which is filled with a tough-curing resin as a sealant 6 and has a casing which can be destroyed during the installation of the profile 1;1';11;21;31;41;51. The sealant 6 forms a curing sealing layer 16 between the contact surfaces 4;14;24;34;44;54 of the profile 1;11;21;31 and a corner, and in gaps present there, or between the profile 31;41 and the side surfaces of said joint 48;58.

Spikes 5;15;25;35;45 are distributed over the length of the profile 1;1';11;21;31;41;51, on that side of the central part 2;2';12;22;32;42;52 and/or of the side wings 3;3';13;23;33;43;53 which is directed toward a building corner or surface in each case, for the purpose of specifically destroying the hollow body 7, the spikes 15 of a profile 11 for outer corners, in the installed state, being broken off or butting laterally against the side wings 13, in a state in which they are bent over against said side wings, or else are merely long enough for the spikes 35, in the installed state of the profile 31, to butt against the wall of a building and no more, if at all.

The insides of the side wings 3;3';13;23;33;43;53, which are directed toward the sides of a corner, have contact surfaces 4;14;24;34;44;54, with a profiling made of longitudinal or transverse grooves, diamond formations, corrugations or the like, with the result that a larger surface area for improved adhesion of the sealant 6, and thus also of the profile 1;1';11;21;31;41;51, is achieved and, in addition, a minimum layer thickness of the sealing layer 16, which is cured in a tough or elastic state, is maintained.

Figure 8:
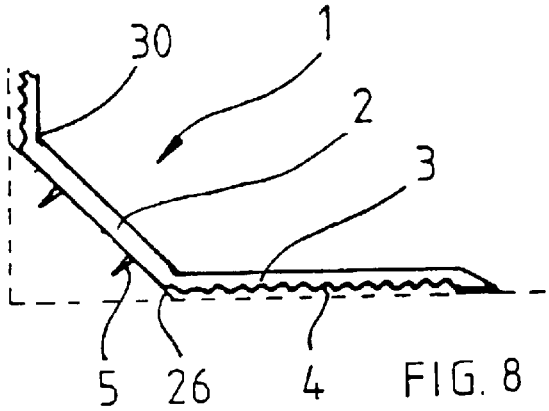
FIG. 8 is an enlarged and sectional view of a profile for an inner corner according to FIGS. 1, 2, 3, 5 and 6.
Figure 9:
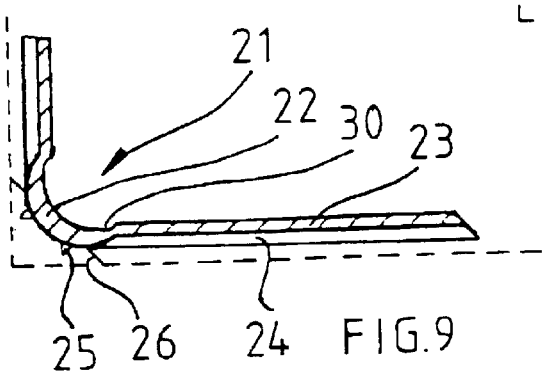
FIG. 9 is a sectional view of a variant of an inner corner.
Figure 12:
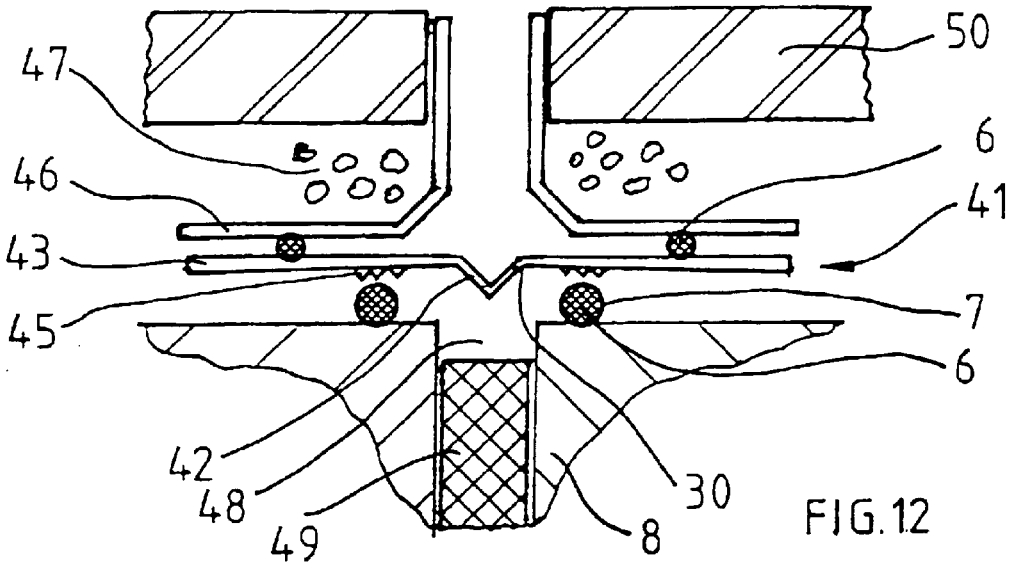
FIG. 12 is a sectional view of the construction of a settlement joint with a profile variant of a first joint seal.
Figure 13:
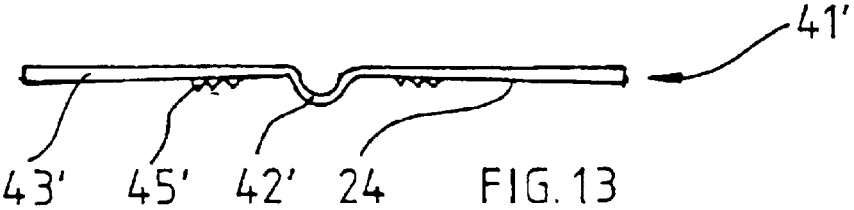
FIG. 13 is a sectional view of a second profile variant in relation to FIG. 12.
Figure 14:
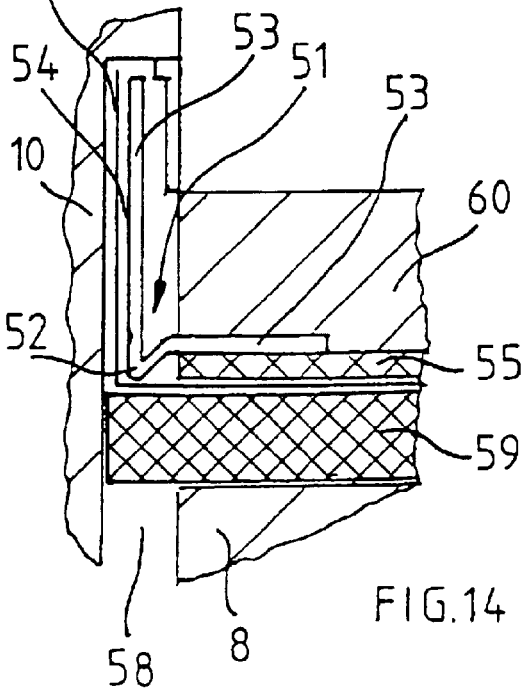
FIG. 14 is a sectional view of a profile for a floor/wall connection with joint.

The profile 1,21 for a right-angled inner corner has, as is illustrated on an enlarged scale in FIG. 8 in particular, a central part 2, which is to be placed at an angle of 45° in relation to said inner corner, and two side wings which are angled outward at an angle of 135° from said central part. It also being possible for said angles to be established only when the profile 1 is installed if, in the state in which the profile 1 is supplied, the side wings 3, depending on the application, are at a somewhat smaller angle than 135°, for the purpose of producing prestressing, or at a somewhat larger angle than 135°, for the purpose of avoiding such prestressing. As is shown in FIGS. 9 and 13, however, it is also possible for the central part 22 to be of concave design or else, as is illustrated in FIGS. 12 and 14, of angled design.

Figure 10:
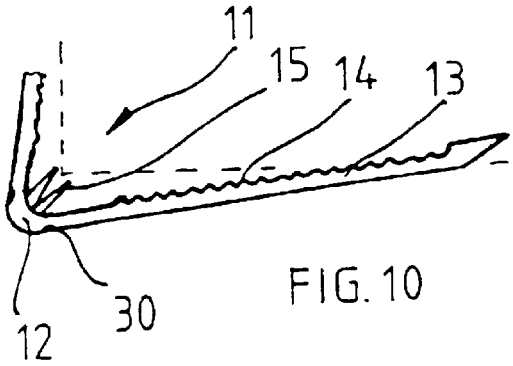
FIG. 10 is an enlarged sectional view of a profile of an outer corner.
Figure 11:
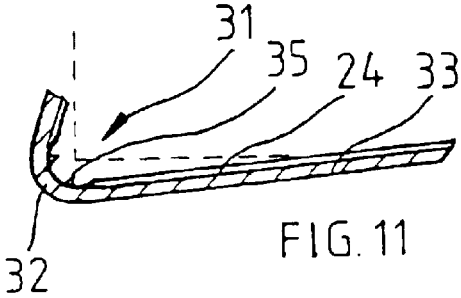
FIG. 11 is an enlarged sectional view of a variant of an outer corner.

A profile 11,31 for a right-angled outer corner, as is shown in FIGS. 10 and 11, has, for the purpose of producing prestressing, an inner angle which is slightly smaller than 90°. This ensures that the sealant 6 cannot escape unimpeded at the edge of the side wings 13,33. In order, immediately following the installation, to avoid the situation where the still free-flowing sealant 6 flows back, thin elastic lips 26 may be provided on the side wings 3;13;23;33;43;53, said lips being supported on a wall 10. The profile 11;31 likewise has spikes 15;35 in the region of its central part 12;32, extending in the direction of a building corner and, when the profile 11 is pressed onto the building corner, breaking off or being positioned against the insides thereof.

The central part 32 may also be constructed in the form of a film hinge 30, and it is likewise also possible for the connecting regions between the central parts 2;12;22;32;42;52 and the side wings 3;13;23;33;43;53 of the profiles 1;11;21;31;41;51 to be formed as film hinges 30. Such film hinges have the advantage that, while having a high tear strength, only a small amount of force is required to deform them, and in that they also only have a low restoring force, which is considerably lower than the adhesive strength of sealant 6 which is not yet cured.

Figure 6:
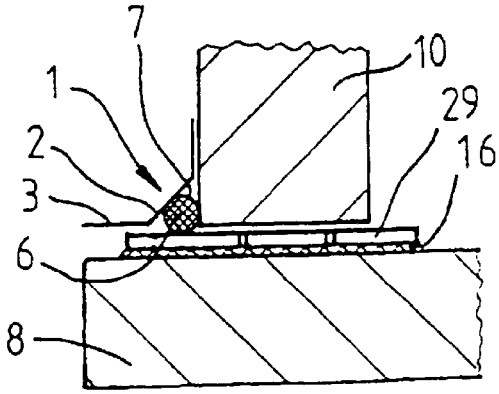
FIG. 6 is a fragmentary, diagrammatic, sectional view of an inner corner with the gap seal positioned against it as part of a sealing system for the horizontal insulation of floor slabs.

When the profile 1 is used in a system for sealing and/or horizontally insulating floor slabs 8, as is illustrated in FIG. 6, a profile 1 is positioned on a wall 10 and a projecting length of slabs 29 beneath the wall 10, the slabs 29 being fitted on a floor slab 8 by means of a sealing layer 16, likewise made of resin. The slabs 29 are preferably provided on their underside, in the same way as the insides of the side wings 3,13 of the profiles 1,11, likewise with a profiled surface, in order to ensure that a minimum layer thickness of the sealant 6 is maintained. By virtue of the slabs 29 having a length which projects beyond the masonrywork of the wall 10, it is possible to connect a horizontal seal to the inside thereof, both in the cellar and on the first floor. Such a design being expedient when the floor slab 8 is not produced from water-impermeable concrete.

Figure 7:
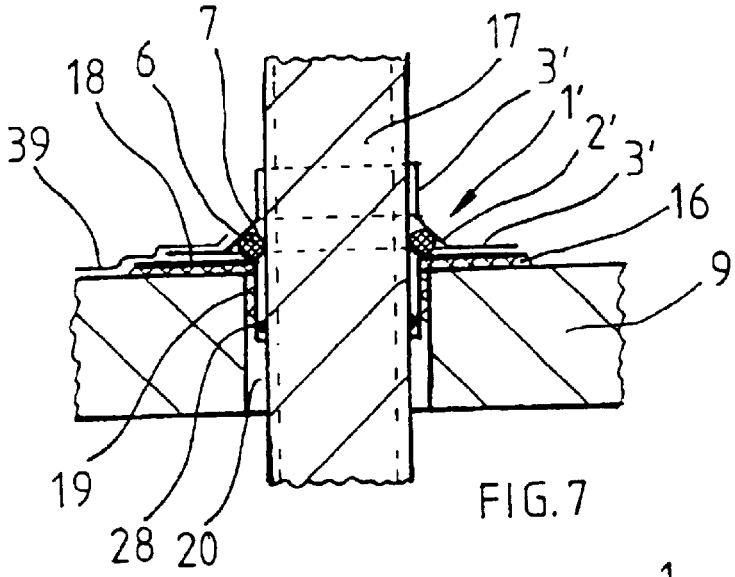
FIG. 7 is a fragmentary, diagrammatic, sectional view of a pipe bushing in combination with a gap seal.

The seal of a pipe 17 guided through a wall 10 or ceiling 9 is ensured by a profile 1' which is formed into a closed ring, the corner which is to be sealed is formed here by the plate-like section 18 of a pipe bushing and the adjacent wall region of the pipe 17. The pipe bushing has a hollow-cylindrical section 19 which extends into a wall recess 20 and in which there is positioned a sealing ring 21 which prevents the sealant 6 of the gap seal from flowing out in the downward direction. A side wing 3' of said profile 1' in this case forms a closed circular cylinder, pipe section or frame, the central part 2' forms a conical ring and the second side wing 3" forms a plate-like disk. Depending on the intended use for a new building or renewal, the space beneath the conical ring of the central part 2' may be formed in different sizes in order, for example in the case of a structure being renewed, that residues of the old roof insulation are also accommodated in addition to the sealant. Therefore, a completely tight seal deep into the old roof construction is achieved by means of the resin. For connection of a sheet material 39, as is shown in FIG. 7, or some other following layer construction, the free surfaces of the side parts 3;13;23;33;43;53 may be provided with a roughened surface.

Installation of the profiles 1;1';11;21;31;41;51 may be facilitated by pressure-exerting tools which are each equipped at least with one roller for an edge or surface which is to be subjected to pressure.

FIG. 12 shows a schematic construction of a settlement joint, which is to be sealed, of a terrace or of a flat roof or parking deck with a virtually planar variant of the profile 41. FIG. 13 shows a further variant of the profile 41', each having a central part 42;42', which may be elastically and/or with film hinges 30, and spikes 45;45' disposed beneath the side wings 43;43'. In this case, the central part 42;42' is disposed freely over a joint 48 which is filled with insulation 49. Disposed above and beneath the side wings 43;43' in each case are hollow bodies 7 filled with sealant 6, although it would also be possible for the sealant 6 to be applied there by means of other known application methods. Positioned on the side wings 43;43' are two angled elements 46, which form the boundary for a covering 50 introduced into a bed of chippings 47.

FIG. 14 illustrates a further variant of a profile 51, which is provided, for example, for a floor/wall connection with a joint 58. Here too, the elastic central part 52 is disposed such that it is oriented freely into the joint 58. The side wings 53 are secured, by a sealing layer (not illustrated in the figure), on the one hand on a sheet material 39 and on the other hand on an intermediate layer 55, which is positioned on the sheet material 39 and, for its part, is disposed on insulation 59 which is supported on the floor 8 of a building.

Figure 15:
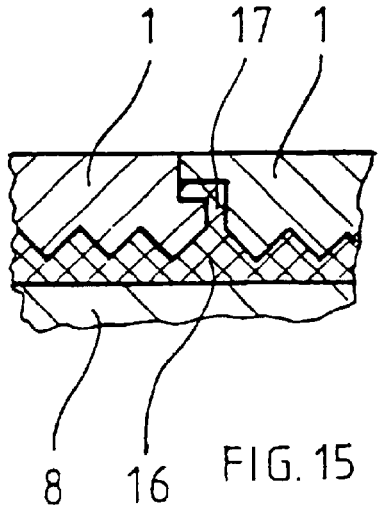
FIG. 15 is a sectional view of an enlarged abutment region of two profiles in section.

As can be seen from FIG. 15, the end-side abutment edges of two sections of the profile 1;11;21;31;41;51 form a gap 17 which, in the installed state of the profiles 1;11;21;31;41;51, is filled with cured sealant 16. This has the result that it is also possible for the sections to be connected to one another permanently in a water-tight manner.

I claim:

1. A gap seal for a building structure, comprising:

a sealant; and a body formed as a hollow body, enclosing said sealant; and a water tight cover layer having a central part with two sides, and side wings disposed at said two sides, at least one of said side wings having a contact surface.

2. The gap seal according to claim 1, wherein said sealant forms a continuous, cured sealing layer between said contact surfaces and a building structure, once said hollow body has been subjected to pressure destroying said hollow body.

3. The gap seal according to claim 1, wherein said hollow body is one of a plurality of hollow bodies.

4. The gap seal according to claim 1, wherein said sealant is a resin which cures to a tough state.

5. The gap seal according to claim 1, wherein said sealant is a resin which cures to an elastic state.

6. The gap seal according to claim 1, wherein said profile is in a form selected from the group consisting of a web form in strips, wound up to form a roll, and a sectional piece.

7. The gap seal gap seal according to claim 3, including film hinges disposed between said central part and said side wings.

8. The gap seal according to claim 1, wherein said central part has at least one surface selected from the group consisting of a planar surface, a concavely curved surface and a convexly curved surface.

9. The gap seal according to claim 1, wherein said central part is at least partially elastic.

10. The gap seal according to claim 1, wherein said contact surfaces of said side wings are directed toward a building surfaces and are profiled.

11. The gap seal according to claim 1, wherein, for a right-angled inner corner, said central part is flat and planar and is to be placed approximately at an angle of 45° in front of a building corner, said two side wings are angled outward at an angle of approximately 135° from said central part.

12. The gap seal according to claim 1, wherein said central part is flexible and constructed to act as a film hinge.

13. The gap seal according to claim 1, wherein said hollow body has a cross-sectional surface area which is larger than a cross-sectional surface area of a free space between a corner of a building and said central part.

14. The gap seal according to claim 1, wherein said hollow body filled with said sealant is disposed beneath each of said side wings prior to the installation of said cover layer.

15. The gap seal according to claim 1, wherein said cover layer being disposed over a joint of a building, in or in front of a corner of a building or on an offset part of a building.

16. A gap seal for sealing a building structure, comprising:

a water tight cover layer having a central part with two sides, side wings disposed at said two sides, at least one of said side wings having a contact surfaces to be coated with a sealant, and film hinges disposed between said central part and said side wings.

17. A gap seal for a building structure, comprising:

a sealant;

a body formed as a hollow body, enclosing said sealant;

a water tight cover layer having a central part with two sides, and side wings disposed at said two sides, at least one of said side wings having a contact surfaces; and said hollow body being placed between a building structure and said central part and, by subjecting said central part to pressure, said hollow body being destroyed resulting in the coating of said contact surfaces with said sealant.

18. The gap seal according to claim 16, wherein said sealant is a resin which cures to an elastic state.

* * * * *